United States Patent [19]

Christopher et al.

[11] Patent Number: 4,617,813

[45] Date of Patent: Oct. 21, 1986

[54] LOCK-PICKING TOOL AND METHOD OF USE THEREOF

[75] Inventors: Walter S. Christopher, Park Ridge; Robert T. Kriskovich, Roselle; Robert L. Steinbach, Glendale Heights, all of Ill.

[73] Assignee: Chicago Lock Co., Chicago, Ill.

[21] Appl. No.: 403,094

[22] Filed: Jul. 29, 1982

[51] Int. Cl.[4] ..... E05B 19/20

[52] U.S. Cl. ..... 70/394; 70/398; 70/406; 70/409

[58] Field of Search ..... 70/394, 395, 397, 398, 70/393, 409, 400, 402, 405, 406, 411, DIG. 76; 33/174 F

[56] References Cited

U.S. PATENT DOCUMENTS

| | | | |
|---|---|---|---|
| 103,837 | 6/1870 | Brady | 70/405 |
| 234,057 | 11/1880 | Parker | 70/405 |
| 1,899,739 | 2/1933 | Von Mehren | 70/395 |
| 2,059,376 | 11/1936 | Lombardo | 70/394 |
| 2,070,342 | 2/1937 | Tarrie | 70/394 |
| 2,087,423 | 7/1937 | Abrams | 70/394 |
| 2,423,734 | 7/1947 | Sterner | 70/411 |
| 3,149,487 | 9/1964 | Martin . | |
| 3,251,206 | 5/1966 | Gruber . | |
| 3,270,538 | 9/1966 | Kerr . | |
| 3,330,141 | 7/1967 | Greenwald | 70/394 |
| 3,572,070 | 3/1971 | Brand | 70/411 |
| 3,868,838 | 3/1975 | Zimmerman et al. | 70/411 X |
| 4,094,176 | 6/1978 | Hughes | 70/411 X |

FOREIGN PATENT DOCUMENTS

| | | | |
|---|---|---|---|
| 473235 | 5/1951 | Canada | 70/395 |
| 2245215 | 4/1975 | France | 70/411 |
| 2389741 | 1/1979 | France | 70/394 |

OTHER PUBLICATIONS

Hughes, "Pickmasters", Custom Security Products Mfg., Inc., Second edition, copyright 1978, p. 2.

*Primary Examiner*—Gary L. Smith
*Assistant Examiner*—Lloyd A. Gall
*Attorney, Agent, or Firm*—Gerlach & O'Brien

[57] ABSTRACT

A picking tool adapted to open a cylinder lock of the axial pin tumbler type having its tumblers arranged in a coplanar configuration, includes a planar torquing core insertable into the lock keyway in a longitudinal direction, a plurality of longitudinal guideway channels formed on opposing faces of the core, and respective tumbler probes longitudinally reciprocable in the channels. A holder, which acts as a handle for manipulating the picking tool, also serves as a housing surrounding the core and the probes. The holder is formed with a pair of radial openings in opposite sides thereof which receive respective brake segments for exerting a frictional drag on the probes. An adjustable hoop clamp surrounds the brake segments for manually adjusting the frictional drag, so that the proper tumbler displacement action can be achieved. Setscrews are threaded into the body of the holder for clamping the probes in their final tumbler-displacing positions. At the rear of the holder, the tail ends of the probes fan out circularly so that they can be more easily manipulated individually. The probes have indicia from which the lock code can be read out after the probes reach their final positions.

17 Claims, 11 Drawing Figures

FIG. 1
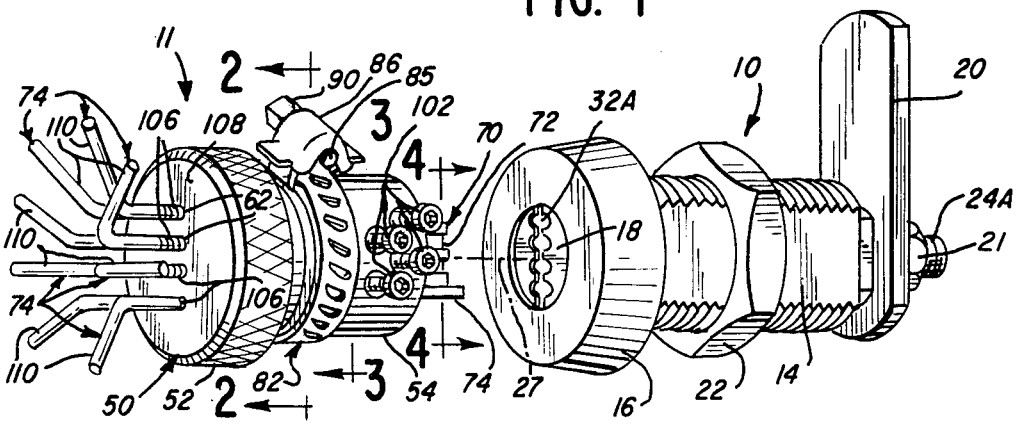
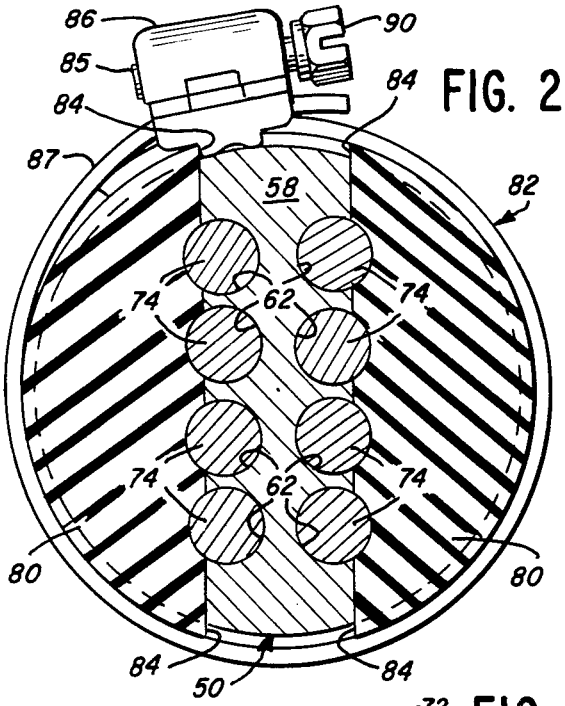
FIG. 2
FIG. 4
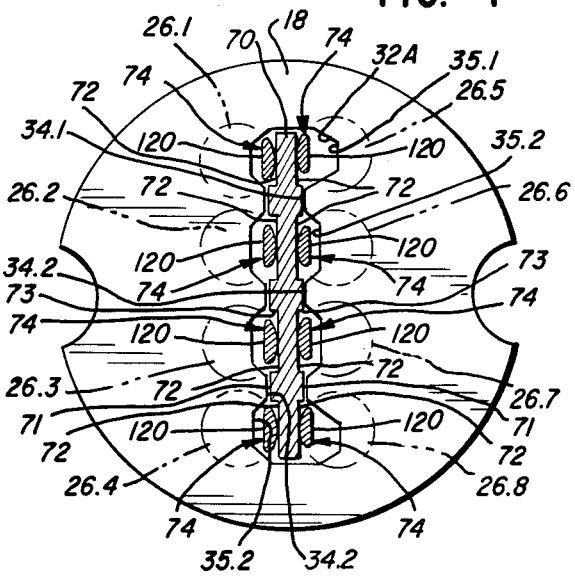
FIG. 3
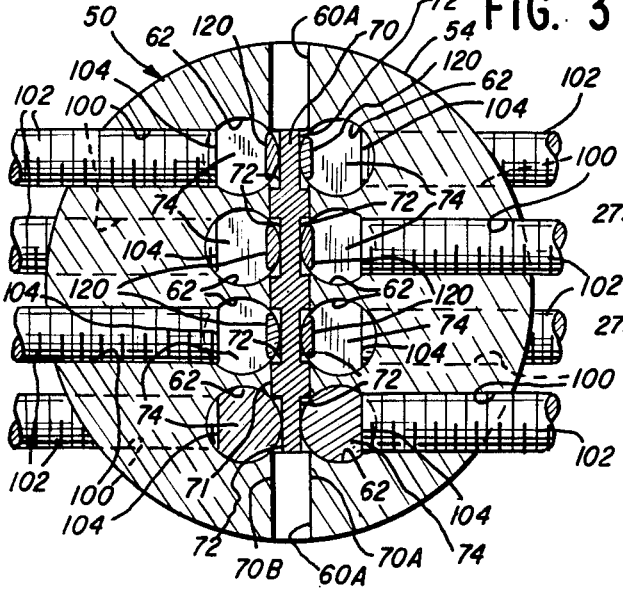
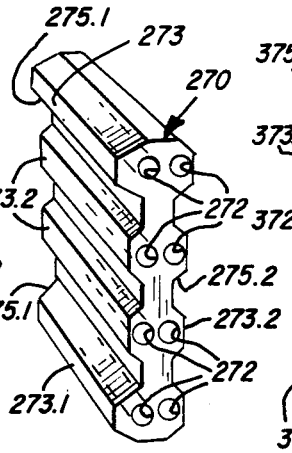
FIG. 5
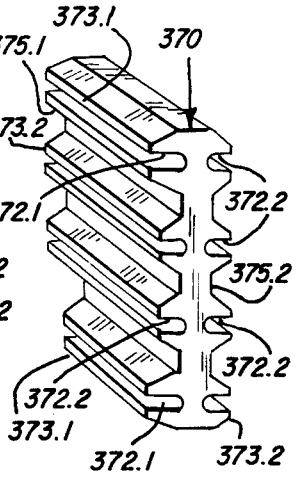
FIG. 6

LOCK-PICKING TOOL AND METHOD OF USE THEREOF

BACKGROUND OF THE INVENTION

This invention relates generally to tools for picking locks, such as are used by locksmiths and lock manufacturers to assist the owner of a lock who has lost the key thereto. The invention particularly concerns a tool for picking a lock of the axial pin tumbler type having its tumblers arranged in a coplanar configuration.

Many axial pin tumbler locks have a cylinder within which tumblers are slidable in a longitudinal direction, i.e., parallel to the axis of the cylinder. In a large proportion of such locks, the tumblers are arranged in a circular pattern, and cylindrically shaped, or so-called circular, keys are required to operate them. The art has developed a number of picking tools to open that type of lock when the owner of the lock has lost his keys. Such picking tools are characterized by cylindrical symmetry.

Recently a much improved type of axial pin tumbler lock has been developed, and is disclosed in co-pending U.S. patent application Ser. No. 283,226, now U.S. Pat. No. 4,446,709, which is assigned in common with the present application. The preferred form of the new lock has its tumblers arranged in two parallel rows of coplanar tumblers, rather than in a circular pattern. Consequently, the conventional type of picking tool, which has its tumbler probes arranged in a circular grouping, will not work with such locks. Such picking tools are exemplified by the disclosures of U.S. Pat. Nos. 3,251,206, 3,270,538, and 3,149,487, and the "Pickmaster" pick (Custom Security Products, Inc.).

A problem in providing a picking tool for a lock of the foregoing type is posed by the need to provide for torquing of the lock cylinder, an important part of the picking technique, in the absence of the center post of the circular key-type lock. Previously, other types of locks, lacking a torquing point for engagement with the tool having the picking probes, were picked with the aid of a second tool or instrument, which was used to apply torque. Such technique, necessitating the simultaneous operation of two tools, is more difficult and requires greater skill. It would be a decided advantage to provide a picking tool which would accomplish both the probing and the torquing functions in one tool.

The lock of the foregoing type also presents a space problem, in that the spacing between rows of tumblers is small, with a correspondingly narrow keyway, and it is through such narrow space that the pick probes must enter. In order to apply a torque to the lock cylinder, it is necessary to provide for engagement of a torquing member with a lock part utilizing for entry into the lock whatever space is afforded in the keyway after insertion of the probes, while permitting suitable operation of the probes at the same time.

SUMMARY OF THE INVENTION

The invention provides a tool for opening a cylinder lock which has a longitudinally extending diametral keyway and at least one planar transverse row of a plurality of tumblers, wherein each of the tumblers is longitudinally reciprocable in the lock and has a side portion projecting into the keyway, and an outer end of the side portion is accessible for engagement with a bitting of a key which is inserted into the keyway. In its preferred embodiments, the tool provided for this purpose by the present invention includes generally planar core means insertable into the keyway in the direction of a longitudinal axis of the core means; a plurality of guideway means on the core means, arranged in side-by-side relationship and extending in the direction of such axis; a plurality of elongated tumbler probes received within respective ones of the guideway means, and longitudinally reciprocable therein; and holder means connected to the core means and adapted to be manipulated manually to apply a torque to the core means about such axis for thereby applying a corresponding torque to a rotatable lock cylinder carrying the tumblers, when the core means is inserted in the keyway.

The picking tool of the present invention is adapted to function with the coplanar tumbler type of lock, and is able to operate within the confines of the narrow access opening and keyway of such a lock, to both manipulate the tumblers and apply a torque to the lock cylinder simultaneously.

More particularly, the torquing function is performed by novel core means, which engages a suitable lock part while also providing support and guidance for the tumbler probes, and which may be provided with the strength and rigidity required for performing such function.

The new picking tool also incorporates unique structure for imposing frictional restraint or "drag" on the tumbler probes, which is adjustable for cooperation with locks having tumblers under various degrees of spring pressure.

The picking tool further embodies a unitary holder for internally mounting the tumbler probes and securing the tumbler-supporting and torquing core means, projecting forwardly from the holder, while serving to mount probe-restraining and probe-locking structure thereon, to provide a compact and readily manipulable precision tool.

These and other objects, advantages and functions of the invention are more fully described hereinafter in connection with particular embodiments. These embodiments serve to illustrate the invention, but the invention is not limited thereto. The detailed description of these illustrative embodiments is intended to be read in conjunction with the attached drawings, in which like reference characters refer to like elements throughout the several figures.

BRIEF DESCRIPTION OF THE DRAWINGS

FIG. 1 is a perspective view of a preferred embodiment of the picking tool of this invention, together with a lock of the type with which it cooperates;

FIGS. 2 and 3 are enlarged cross-sectional views of the picking tool of FIG. 1, taken on the lines 2—2 and 3—3 thereof, respectively;

FIG. 4 is a cross-sectional view of the picking tool of FIG. 1, taken on the line 4—4 thereof, and also includes a front elevational view of a portion of the lock of FIG. 1;

FIGS. 5 and 6 are fragmentary perspective views of respective additional embodiments of one component of the picking tool of the invention;

DETAILED DESCRIPTION OF THE PREFERRED EMBODIMENTS

Figure 7:
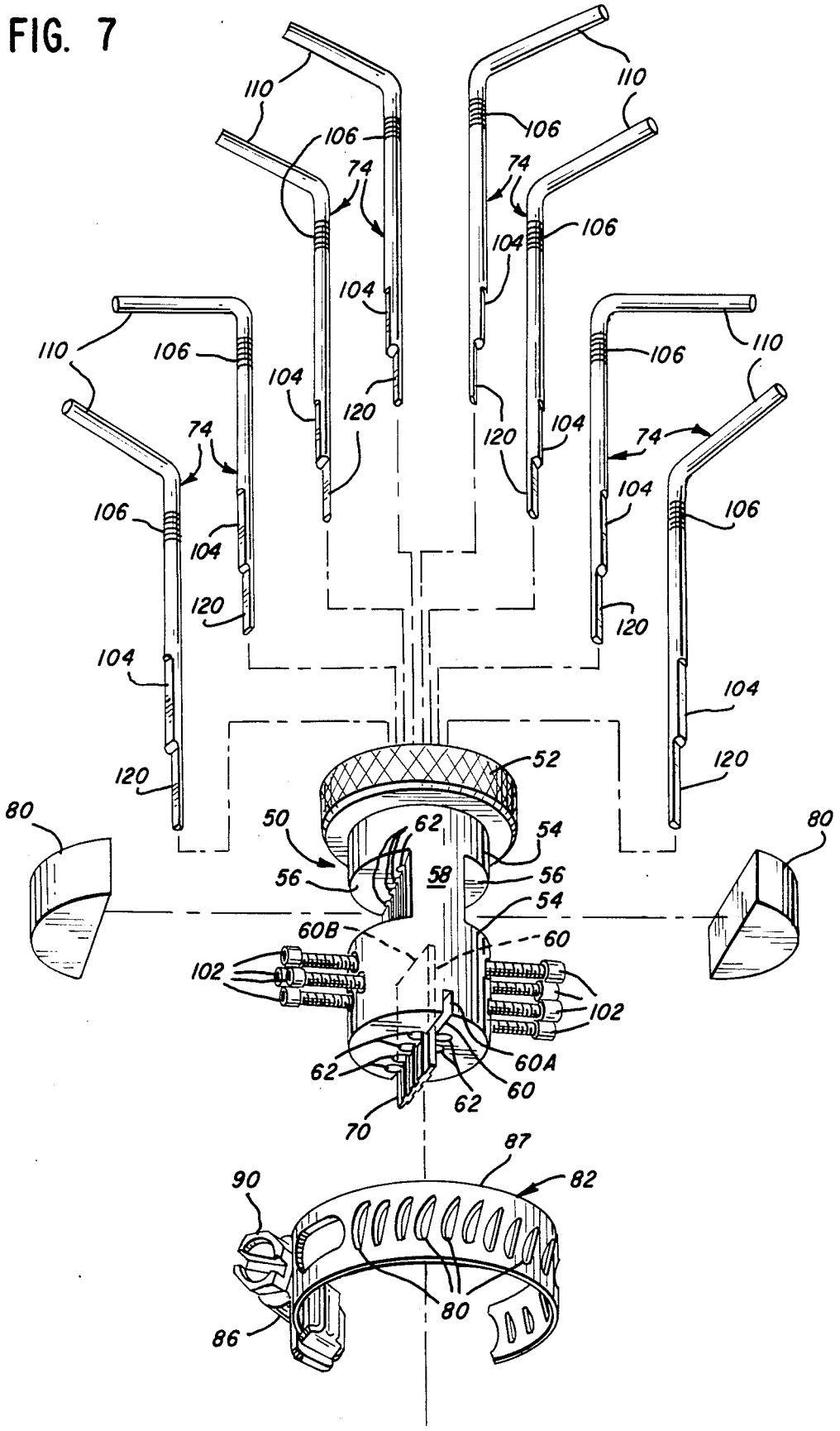
FIG. 7 is an exploded perspective view of the picking tool of FIGS. 1-4.

FIG. 1 illustrates a picking tool or pick 11 in accordance with the present invention, together with a recently developed lock 10, disclosed in the above-identified co-pending application, with which the tool cooperates. Focusing first on the characteristics of the lock 10, to which the tool must be adapted, and referring to FIGS. 1 and 8–10, the lock includes a generally tubular barrel 14, on one end of which is mounted a closure cap 16. A mounting nut 22 is threaded to the barrel 14, for the purpose of securing the lock 10 to some type of lockable enclosure (not shown). A facing plate 18 is received in the barrel 14 behind the closure cap 16, and a spacer 19 is received in the barrel behind the facing plate. At the opposite end of the barrel is a locking arm 20. The locking arm 20 is secured by a nut 21 to a threaded extension 24A of a lock cylinder 24, which is contained within the barrel 14 and abuts on the spacer 19. The cylinder 24, the spacer 19, and the facing plate 18 are interconnected, so that a torque applied to the facing plate 18 is transmitted to the cylinder 24. When the lock is unlocked, the cylinder can be rotated by applying a torque to the facing plate. When the cylinder rotates, the locking arm rotates with it, to release the door on the locked enclosure.

Figure 8:
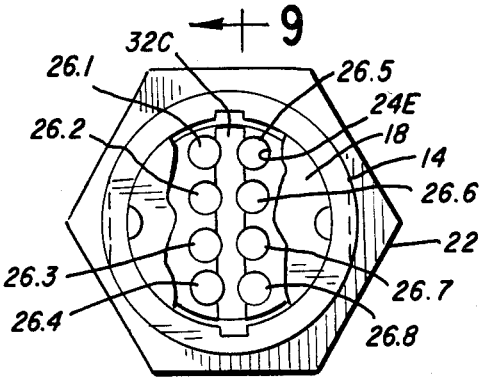
FIG. 8 is a front elevational view of the lock of FIG. 1, with parts thereof removed and broken away to reveal internal structure.
Figure 9:
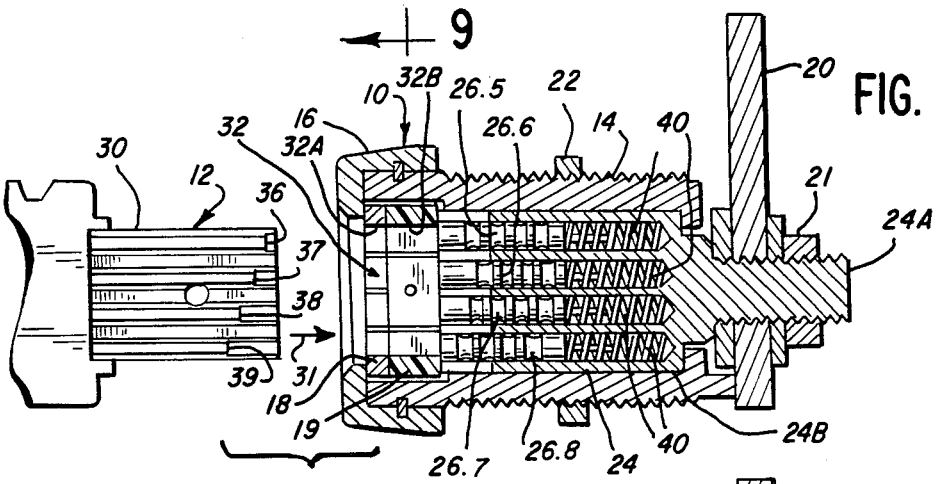
FIG. 9 is a longitudinal sectional view of the same lock, taken substantially on line 9—9 of FIG. 8, together with a fragmentary side elevational view of a key which is adapted to open the lock and is in position to be inserted into the keyway thereof.
Figure 10:
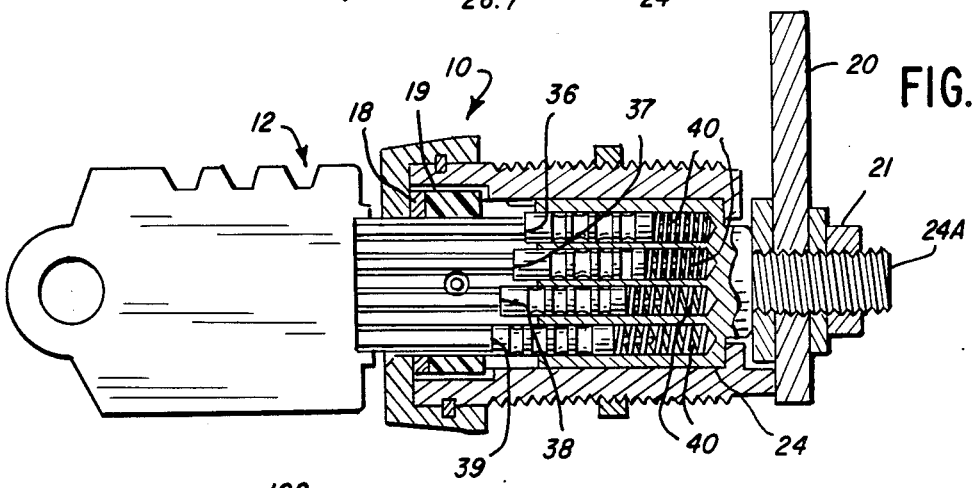
FIG. 10 is a view similar in all respects to FIG. 9 except that the key is inserted in the keyway of the lock.

As best seen in FIGS. 8–10, within the cylinder 24 are eight pin tumblers 26.1–26.8, which must be appropriately manipulated in order to open the lock. Each of these tumblers is oriented in a direction parallel to the longitudinal axis 27 (FIG. 1) of the lock, and is longitudinally reciprocable therein.

FIG. 8 most clearly shows that these tumblers are arranged in two groups of four tumblers each, one group being designated 26.1–26.4 and the other being designated 26.5–26.8. Each group of four tumblers is arranged one above the other in spaced apart parallel relation, to form a planar, vertically oriented (as seen in the view of FIG. 8) row or array, and the two planar rows are in spaced parallel relationship to each other. This arrangement permits all eight of the tumblers to be operated by a flat-bladed key 12, which includes a generally planar blade 30 having two opposite faces each formed with four forwardly facing spaced apart bittings thereon. The bittings 36–39 on one face of the blade are visible in FIGS. 9 and 10.

As indicated by an arrow 31 in FIG. 9, the key blade 30 is inserted into a diametral keyway 32, which comprises a key opening 32A formed in the facing plate 18, a similar opening 32B in the spacer 19, and a free space 32C (FIG. 8) between the two planar rows of tumblers 26.1–26.4 and 26.5–26.8. The wall of the key opening 32A (see FIG. 4) in the facing plate 18 includes alternating lands 34.1, 34.2 and grooves 35.1, 35.2 on opposite sides thereof, the grooves optionally varying in depth. Upon insertion of the key blade 30 into the keyway 32, the bittings 36–39 longitudinally displace their respective tumblers 26.5–26.8 the proper distances, against the biasing force of tumbler springs 40, as seen in FIG. 10. The corresponding four bittings (not visible) on the opposite face of the blade 30 similarly displace their respective tumblers 26.1–26.4. In order to operate properly, the picking tool 11 must simulate the action of the key 12, by displacing the eight tumblers the proper respective distances in the longitudinal direction.

Referring to FIGS. 1–3 and 7, the tool 11 includes a unitary holder 50 in the form of a generally cylindrical body machined from a metallic material. The holder 50 has two diameters, including a relatively large diameter characterizing a rearmost handle portion 52 thereof, which is grasped by the operator who uses the tool 11 to pick the lock 10. The circumferential surface of the handle portion 52 is knurled to facilitate manipulation of the tool 11. The remainder of the holder 50 has a smaller diameter, characterizing a forward portion 54, which serves as an enclosure and support for the working parts of the tool, to be described hereinafter.

The smaller diameter forward portion 54 is formed with a pair of substantially D-shaped transverse segmental openings 56 therein, for the purpose of receiving brake segments (described below) in the openings. These openings 56 extend radially inwardly from opposite sides of the forward portion 54, and are separated by a relatively thin diametral neck of material 58.

The holder 50 also is formed with a number of longitudinally extending openings therein, including a planar diametral slot 60 and a plurality of bores 62. The bores extend longitudinally entirely through the holder 50 from front to rear, while the slot 60 only extends part of the way longitudinally into the holder 50 from the forward end thereof. The forward portion 60A of the slot 60 extends across the entire diameter of the forward portion 54 of the holder 50, while the rearward portion 60B of the slot 60 has a width smaller than the diameter of portion 54, and thus does not extend through the side walls thereof. Four bores 62 are located on each side of the planar slot 60, and the side of each such bore communicates with the slot.

The planar diametral slot 60 receives a substantially planar metallic torquing core member 70, which has a width in the diametral direction of the cylindrical holder 50 adapted to fit relatively closely within the smaller rear portion 60B of the slot 60. Referring to FIGS. 3 and 4, the core member 70 has two opposite faces 70A and 70B, each of which is provided with alternating lands 71 and grooves 73, to form four open channels 72 extending parallel to the longitudinal axis of the core member. The channels are located directly opposite respective bores 62 when the core member 70 is received within the slot 60. Eight tumbler probes 74 are received within respective bores 62 and also within the respective channels 72 which are associated therewith, the probes fitting loosely enough within the bores and channels to be easily reciprocable therein in the longitudinal direction.

The channels 72, while relatively shallow, are deep enough to function as longitudinal guides for the probes 74; that is, they prevent the probes from straying out of their proper operating positions so long as the probes remain within the channels. The function of containing the probes within the channels is performed by the holder 50, which closely surrounds the core member 70 and the probes 74, its longitudinal probe-containing bores 62 being located in closely confronting and communicating relationship to the channels 72, so as to confine the probes against the surface of the core member.

The probes 74, which are formed of substantially cylindrical metal wires, serve to longitudinally displace the lock tumblers 26.1–26.8 in the manner of the key blade 30, and therefore, must be longitudinally slidable within the bores and channels in order to move to whatever position is required by the code of any lock which might be encountered. That is, the probes 74 must be movable to respective positions which correspond to the locations of the bittings 36–39 etc. of any key blade 30 when the probes are inserted into the keyway 32.

However, the probes must not be free to move prematurely in the foregoing fashion. Rather, when first inserted into the keyway they must exert a large enough force to longitudinally displace their respective tumblers 26.1–26.8 the required distance to open the lock. At that point, assuming the lock cylinder 24 is being "torqued" in a manner understood in the locksmith art, the displaced tumblers will bind slightly and then move no further in response to the urging of their respective probes 74. In order to hold the probes stationary during the time that they are longitudinally displacing their respective lock tumblers, and yet release them thereafter when the tumblers bind, respective D-shaped brake segments 80, preferably formed of a resiliently compressible material, such as a natural or synthetic elastomer, are received within the two D-shaped transverse segmental openings 56 formed in the holder 50, and are retained therein by an adjustable hoop clamp 82 of conventional design. As best seen in FIG. 2, the diameter of the wires from which the probes 74 are formed is only a little less than the diameter of the bores 62 in which they are received. Hence, at the locations where the transverse openings 56 intersect the bores 62, the probes 74 protrude laterally into the openings 56 and thereby compressively engage the flat surfaces of respective brake segments 80.

This engagement causes the segments to provide a frictional braking force which prevents longitudinal motion of the probes during the time when the probes are displacing their respective lock tumblers. But when the tumblers bind, the frictional threshold of the braking force is exceeded, and thereafter the probes slide against the flat surface of the brake segments to avoid moving the tumblers beyond their critical lock-opening positions. To achieve the correct braking force, the hoop tension exerted upon the segments by the hoop clamp 82 is adjustable. To prevent the hoop clamp from impinging upon the holder 50 in the region between the brake segments 80, the radial thickness of the brake segments is chosen to exceed the radial depth of the transverse openings 56, so that the brake segments project laterally outwardly from the holder 50, as illustrated in FIG. 2 by the projecting portions 84.

Referring to FIGS. 1 and 7, the clamp adjustment mechanism is conventional, and includes a worm gear 85, which is captured within a housing 86 and engages a hoop-shaped track formed by a bent strip 87 having a series of openings 80 therein at locations spaced regularly therealong. A slotted head 90 integral with the gear 85 may be turned by a screwdriver, to manually select the hoop tension. Such tension, acting on the brake segments 80, determines the frictional braking force exerted upon the probes 74.

After each probe follows its corresponding tumbler to the binding position, it is clamped in place so that it is not thereafter dislodged while the operator continues to work on the other tumblers. The clamping serves to preserve the positions of all the probes as an indication of the code of the lock then being opened, so that a new key can be cut for the owner of the lock. For probe-clamping purposes, transversely extending tapped bores 100 (FIG. 3) are provided in the forward portion 54 of the holder 50, and setscrews 102 are threadedly engaged therein. The tapped bores 100 are so located that they intersect respective probe bores 62. Therefore, when the setscrews are tightened down, they impinge upon the probes and clamp them against the core member 70, to prevent any further longitudinal displacement relative to the holder 50. A flat surface 104 is cut into the side of each probe 74, intermediate its opposite ends, for engagement with the corresponding setscrew 102.

Rearwardly of the flat surfaces 104, each probe is provided with markings 106 comprising lock code indicia which can be read against the rear surface 108 (see FIG. 1) of the holder 50, to reveal the lock code, so that a new key can be cut for the owner of the lock. The particular lock code indicium on each probe which is closest to the holder rear surface 108 indicates the lock-opening position for the particular lock tumbler with which that probe is engaged. The aggregate reading taken from the indicia 106 of all eight probes constitutes the complete code for a given lock, from which a replacement key can be made.

The rearmost portion 110 of each probe extends rearwardly of the holder and is bent at an oblique angle to the longitudinal direction, so as to provide a convenient handle for individual manipulation of each probe.

Because of the planar arrangement of the two groups of lock tumblers 26.1–26.4 and 26.5–26.8, the cylindrical symmetry of the holder 50 is not carried through to the working parts of the tool 11. Thus, the core member 70 is generally planar in configuration, and the setscrew bores 100 are substantially perpendicular to the plane of the core member. Consequently, the setscrews 102 also are oriented perpendicularly to the plane of the core member, and when they impinge even relatively lightly upon the intermediate flat surfaces 104 of the probes, they impart a definite angular orientation to the probes: that is, the intermediate flat surfaces 104 of the probes are substantially parallel to the plane of the core member 70, and the probes are not permitted to rotate out of that orientation.

With the angular positions of the probes 74 thus defined, their handle portions 110 are all preferably bent in different radial directions relative to the generally cylindrical body of the holder 50, so that they diverge in a circular pattern from each other as seen in FIG. 1. This provides the maximum angular separation between each two adjacent probe handles 110, so that they can be conveniently manipulated with a minimum of mutual interference.

The tips or forwardmost portions of the probes 74 are provided with end flat surfaces 120, which extend rearwardly to the intermediate flat surfaces 104. The end flat surfaces 120 also are substantially parallel to the plane of the core member 70, and they reduce the thickness of the probes 74 to a greater extent than the intermediate flat surfaces 104. The tips of the probes 74 constitute the thinnest portions of the probes, and they are the only portions which extend into the keyway 32 to engage the lock tumblers 26.1–26.8. They must be quite thin to allow for reciprocal movement in the keyway 32 without scraping the sides of the keyway or otherwise engaging lock parts other than the tumblers. Use of the probes 74 as means for applying torque to the lock cylinder is undesirable, inasmuch as the probes should be left free to move in and out of the keyway. Moreover, the thin tips, having the end flat surfaces 120, would bend and may break during such application of torque, and the operator may be unable to determine what parts of the locks are engaged by the probe ends.

Figure 11:
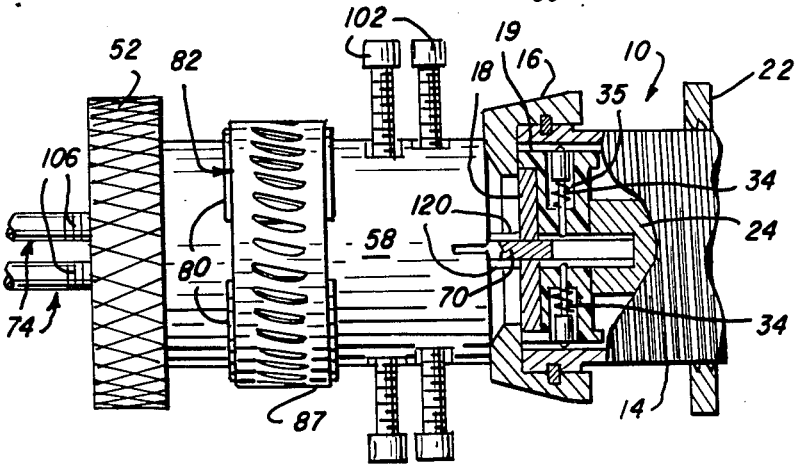
FIG. 11 is a fragmentary, partly sectional view of the lock, rotated 90° with respect to FIG. 10, with the picking tool of this invention inserted in the keyway of the lock.

The core member 70 of the invention provides for application of the desired torque to the lock cylinder, while affording full freedom of movement to the probe tips and also supporting them and guiding them for accuracy in use. Thus, the core member 70 is positioned between two parallel rows of probes 74, which are in spaced parallel relation to each other. The core member 70 projects forwardly from the holder 50, as illustrated in FIGS. 1, 7, and 11, to extend into and a short distance beyond the key opening 32A in the facing plate 18, while the probe tips, having the end flat surfaces 120, extend further into the keyway 32. The core member 70 then is in position to transmit torque to the facing plate 18, for transmittal to the lock cylinder, via the interconnections between the parts, upon manual application of torque to the holder 50 about its longitudinal axis 27 (FIG. 1). As seen in FIG. 3, the lands 71 on the surfaces of the core member 70 register with the spaces between the probes 74. Torque is transmitted to the wall of the key opening 32A in the facing plate 18, by engagement of the lands 71 on the core member 70 with opposing lands 34.1, 34.2 in the wall of the facing plate key opening 32A, such engagement being effected through the spaces between the probes 74, as will be seen on reference to FIG. 4. Sufficient clearance remains for the probe tips to move freely in the facing plate key opening 32A (the free space, however, being exaggerated in FIG. 4), as well as in the spacer 19 and the cylinder 24.

FIGS. 5 and 6 illustrate further embodiments 270 and 370, respectively, of the core member of the invention, which provide additional guidance and support for probes, but, on the other hand, are more difficult and expensive to make. Also, the embodiments of FIGS. 5 and 6 are contoured to fit relatively snugly in the facing plate key opening 32A, which reduces play and tends to improve torquing and accuracy in probing, but, on the other hand, may also make the tool less easy to manipulate. Space limitations dictate the use of probes with such embodiments 270 and 370 that have a lesser diameter or thickness than the probes 74 employed with the first embodiment 70, for the same size lock 10.

FIG. 5 illustrates a metallic second core member embodiment 270, which is formed substantially in the configuration or outline of the facing plate key opening 32A, having alternate lands 273.1, 273.2, and grooves 275.1, 275.2 on its opposite sides. The second core member embodiment 270 fits within the facing plate key opening 32A similarly to the key blade 30. This embodiment 270 is limited to use with the illustrative facing plate 18, and a different arrangement of enlarged grooves 35.1 in the facing plate requires a core member having a correspondingly different arrangement of enlarged lands 275.1. As a further alternative, not illustrated, a core member useful with facing plates having either no enlarged grooves or different arrangements of enlarged grooves is constructed like the embodiment 270 of FIG. 5, but with its lands and grooves all one size, corresponding to the sizes of the lands 273.2 and the grooves 275.2. In either case, the core member is provided with internal guideways 272 of circular cross section, behind the land surfaces, and preferably cylindrical portions of metallic wire probes or the like (not shown) are received therein and entirely surrounded by the core member. Inasmuch as the probes are not accessible for contact with the setscrews 102 where they are enclosed in the second core member embodiment 270, it is preferred to locate the setscrews 102 in the holder 50 to the rear of the core member, where such contact may be made.

FIG. 6 illustrates a metallic third core member embodiment 370, constituting a modification of the embodiment 270 of FIG. 5. The third embodiment 370 is provided with lands 373.1, 373.2 and grooves 375.1, 375.2 like the corresponding lands 273.1, 273.2 and grooves 275.1 and 275.2 of the second embodiment 270. In the third embodiment 370, guide channels 372.1, 372.2 of U-shaped cross section extend inwardly from the surfaces of the lands 373.1, 373.2, for reception therein of preferably flat metallic probe portions (not shown) having rectangular tips. The third core member embodiment 370 is easier and less expensive to make than the second embodiment 270. The channels 372.1, 372.2, being deeper than the channels 72 of the first core member embodiment 70, provide additional guidance and support for the probes, as compared to the latter channels.

It thus is apparent that the shape of the tumbler probes may be varied, if desired, with the channels in the core member configured to best accommodate the shape of and cooperate with the probes. The preferred illustrative holder 50 and several embodiments of the probes and the core member, while shown and described as constructed of metal, alternatively may be constructed of other suitable materials, such as plastics.

While preferred embodiments of the picking tool of the invention have been illustrated and described, and reference has been made to certain changes and modifications which may be made therein, it will be apparent to those skilled in the art that various additional changes and modifications may be made therein, within the spirit and scope of the invention. It is intended that all such changes and modifications be included within the scope of the appended claims.

We claim:

1. In a lock-picking tool of the type having manually manipulable holder means, tumbler probes supported on said holder means and extending in the direction of a longitudinal axis of the holder means and being reciprocable in said direction, and setscrews threadedly engaging said holder means for clamping said tumbler probes to prevent such reciprocation relative to said holder means, the improvement which comprises:

means providing a diametral opening in a forward end of said holder means;

generally planar core means received within said diametral opening and projecting forwardly therefrom for transmitting torque from said holder means to the cylinder of a lock which is to be picked; and means providing a plurality if longituidnal probe-receiving bores in said foward end and arranged in a planar transverse row with one side of each bore communicating with said diametral opening so that one side of the probe received in the bore extends into the diametral opening.

2. A tool as defined in claim 1 and including an outer surface on said core means and adapted for engagement with a keyway wall in said lock to effect said transmission of torque.

3. A tool as defined in claim 1 and including a plurality of guideway means on said core means and arranged in side-by-side relationship to extend in the direction of said axis for receiving said one side of a probe in each guideway means.

4. A tool as defined in claim 1, further comprising:

brake means having a flat surface mounted on said holder means in frictional engagement of the surface with said tumbler probes and for movement relative thereto to vary the degree of said firctional engagement;

and means for manually adjusting said degree of frictional engagement.

5. A method of picking a cylinder lock having a longitudinally extending diametral keyway defined by a keyway wall connected to the lock cylinder for transmitting torque thereto, and at least one planar transverse row of a plurality of tumblers mounted in the lock cylinder, each of which tumblers is longitudinally reciprocable in the lock and has a side portion projecting into said keyway and an outer end of said side portion accessible for engagement with a key which is inserted into said keyway, which method comprises providing a tool having:

generally planar core means insertable in said keyway in the direction of a longitudinal axis of the core means for a limited distance short of said outer ends of said tumbler side portions, said core means having an outer surface engagable with said keyway wall for applying a torque to the lock cylinder about said axis;

a plurality of guideway means in said core means, arranged in side-by-side relationship and extending in the direction of said axis;

a plurality of elongated timbler probes received within respective ones of said guideway means, and longitudinal reciprocable therein in spaced relation to said keyway wall when said core means and said probes are inserted in the keyway and the core means is engaged with the keyway wall;

said probes extending longitudinally beyond said core means in said keyway for engaging the probe ends with respective ones of said outer ends of said tumbler side portions;

brake means engageable with said probes for frictionally retarding the longiduinal reciprocation of the probes within said guideway means;

and holder means connected to said core means and adapted to be manipulated manually;

and manually manipulating said holder means to insert said core means and said probes in said keyway and engage said outer surface of the core means with said keyway wall to apply torque to the lock cylinder while engaging the probe ends with respective ones of said outer ends of said tumbler side portions.

6. A method of picking a cylinder lock having a longitudinally extending diametral keyway defined by a keyway wall connected to the lock cylinder for transmitting torque thereto, and at least one planar transverse row of a plurality of tumblers mounted in the lock cylinder, each of which tumblers is longitudinally reciprocable in the lock and has a side portion projecting into said keyway and an outer end of said side portion accessible for engagement with a key which is inserted into said keyway, which method comprises providing a tool having:

generally planar core means insertable in said keyway in the direction of a longitudinal axis of the core means and having an outer surface engageable with said keyway wall for applying a torque to the lock cylinder about said axis;

a plurality of guideway means in said core means, arranged in side-by-side relationship and extending in the direction of said axis;

a plurality of elongated tumbler probes recieved within respective ones of said guideway means, and longituidnally reciprocable therein in spaced relation to said keyway wall when said core means and said probes are inserted in the keyway and the core means is engaged with the keyway wall;

brake means engageable with said probes for frictionally retarding the longitudinal reciprocation of the probes within said guideway means;

and holder means connected to said core means and adapted to be manipluated manually;

and manually manipulating said holder means to insert said core means and said probes in said keyway and engage said outer surface of the core means with said keywat wall to apply torque to the lock cylinder while engaging the probe ends with respective ones of said outer ends of said tumbler side portions.

7. A method according to claim 6 wherein said guideway means comprise alternate lands and grooves, said grooves receive respective ones of said probes therein in spaced apart relation, and said lands register with the spaces between said probes and comprise said outer surface of said core means engageable with said keyway wall.

8. A tool for picking a cylinder lock having a longitudinally extending diametral keyway and at least one planar transverse row of a plurality of tumblers, each of which tumblers is longitudinally reciprocable in the lock and has a side poriton projecting into said keyway and an outer end of said side portion accessible for engagement with a key which is inserted into said keyway; said tool comprising:

holder means comprising a generally cylindrical body provided with a generally planar diametral opening extending longitudinally at least part way into the body from a forward end thereof, a plurality of generally cylindrical bores extending longitudinally through the body and arranged in a planar transverse row with one side of each bore communicating with said diametral opening, and a transverse opening extending radially part way into the body and intersecting said bores;

generally planar core means having a rearward end received in said diametral body opening and a forward end insertable in said keyway in the direction of a longitudinal axis of the core means;

a plurality of guideway means in said core means, arranged in side-by-side relationship and extending in the direction of said axis;

a plurality of elongated tumbler probes received for longitudinal reciprocation in respective ones of said bores, with one side of each probe extending into said diametral opening and received in one of said guideway means; and brake means recieved in said transverse body opening for exerting transverse inward pressure on said probes to frictionally retard said probe reciprocation;

said holder means being adapted to be manipulated manually to insert the core means and the probes in said keyway, and apply a torque to the core means about said axis, whereby a corresponding torque is transmitted by the core means to the lock cylinder, while engaging the probe ends with respective ones of said outer ends of said tumbler side portions.

9. A tool as defined in claim 8 and including an outer surface on said core means and adapted for engagement with a keyway wall in said lock to effect said transmission of torque.

10. A tool as defined in claim 8 wherein said transverse opening comprises at least one generally D-shaped segmental opening extending radially inwardly from the circumference of said body of said holder means, and said brake means comprises a generally D-shaped segmental brake body received within said radial opening with a flat surface of the body facing said row of bores for frictional engagement of the surface with said probes.

11. A tool as defined in claim 10 further comprising retaining means surrounding said brake body and said holder means to retain said brake body within said radial opening.

12. A tool as defined in claim 11 wherein said retaining means comprises means for exerting and manually adjusting a transverse inward pressure upon said brake body in a mannar to determine the degree to which the longitudinal reciprocation of said tumbler probes is retarded.

13. A tool as defined in claim 12 wherein said pressure-exerting and adjusting means comprises a hoop clamp surrounding said brake body and said holder means, and manually operable means for adjusting the hoop tension thereof.

14. A tool as defined in claim 13 further comprising respective clamping means adapted to lock said tumbler probes against reciprocation relative to said holder means.

15. A tool as defined in claim 14 further comprising indicia on said tumbler probes for indicating the positions at which the probes are clamped relative to said holder means.

16. A tool as defined in claim 14 wherein said clamping means comprises means providing a threaded bore in said holder means body corresponding to each of said tumbler probes, each of said threaded bores being oriented substantially perpendicularly to the plane of said core means and directed towards the corresponding tumbler probe, and a setscrew threadedly received in each of said threaded bores for engaging the corresponding tumbler probe.

17. A tool as defined in claim 16 wherein each of said tumbler probes comprises a generally cylindrical member formed with a flattened and reduced-thickness first portion at a forward end thereof, said first portion extending forwardly of said holder means for entering into said keyway and engaging the outer end of said side portion of one of said lock tumblers, a flattened and less reduced thickness second portion disposed rearwardly of said first portion for clamping engagement of its flat surface with one of said setscrews, and a rear portion disposed rearwardly of said second poriton and extending rearwardly from said holder means, said rear portion being bent toward a generally radial direction relative to said holder means body to provide a handle for manually manipulating the tumbler probes, said handle being angularly spaced from the handles of the remaining tumbler probes when the flat surface of said second portion is in engagement with a setscrew.

* * * * *